US005127250A

United States Patent [19]

Nagata

[11] Patent Number: 5,127,250

[45] Date of Patent: Jul. 7, 1992

[54] ROLLER LEVELER

[75] Inventor: Toshio Nagata, Tokyo, Japan

[73] Assignee: Kahan Sendan Kikai Kabushiki Kaisha, Chiba, Japan

[21] Appl. No.: 740,455

[22] Filed: Aug. 5, 1991

[30] Foreign Application Priority Data

Apr. 23, 1991 [JP] Japan ..... 3-117903

[51] Int. Cl.[5] ..... B21D 1/02

[52] U.S. Cl. ..... 72/165; 72/163

[58] Field of Search ..... 72/164, 165, 160, 163

[56] References Cited

U.S. PATENT DOCUMENTS

| | | | |
|---|---|---|---|
| 1,414,371 | 5/1922 | Nilson | 72/162 |
| 1,714,094 | 5/1929 | Kilmer | 72/164 |
| 2,592,948 | 4/1952 | Peterson | 72/163 |
| 3,327,509 | 6/1967 | Roesch | 72/165 |
| 3,648,505 | 3/1972 | Eibe | 72/165 |

FOREIGN PATENT DOCUMENTS

| | | | |
|---|---|---|---|
| 20620 | 1/1986 | Japan | 72/165 |
| 62-203616 | 9/1987 | Japan . | |

*Primary Examiner*—Daniel C. Crane

*Attorney, Agent, or Firm*—Graybeal Jackson Haley & Johnson

[57] ABSTRACT

A roller leveler comprises a raisable upper work roll group, and a lower work roll group, the upper and lower work roll groups being arranged in a zigzag form so that the axes of three work rolls adjacent to each other at upper and lower sides and three points of intersection with the plane crossing these axes may make three vertexes of an isosceles triangle, with alternate lower work rolls in the lower work roll group being raisable to act as upper work rolls when a relatively thick hoop is leveled.

3 Claims, 7 Drawing Sheets

ROLLER LEVELER

BACKGROUND OF THE INVENTION

1. Field of the Invention

This invention relates to a roller leveler used for leveling the surface shape of a hoop passed through a rolling process.

2. Description of the Prior Art

A roller leveler basically comprises an upper work roll group and a lower work roll group both defining a pass line, through which a rolled hoop is passed. Both of the upper and lower work roll groups are provided in a zigzag form so that three points of intersection of three adjoining upper and lower work roll axes with the plane crossing them may form three vertexes of an isosceles triangle.

The hoop passing through the pass line is bent along the cylindrical surfaces of the respective work rolls and extended up to its plastic zone. As a result, the strain of the hoop surface is removed. That is, the surface shape of the hoop is leveled.

However, on the basis of the diameters of the work rolls of a roller leveler or the respective pitches between mutual upper work rolls and between mutual lower work rolls, the thickness of the hoop which can be processed by the roller leveler is determined. If the processable range of the hoop thickness is wider, the leveling of the hoop processed by using a plurality of roller levelers can be practiced by a single roller leveler.

In a prior art, there has been proposed a roller leveler (refer to Japanese Patent Disclosure (KOKAI) No. 62-203616), in which a pair of upper and lower work rolls adjacent to each other in a diagonal direction are made movable in an upper and lower direction to the other pair of upper and lower work rolls adjacent to these work rolls, respectively, and the lower work roll group is made movable in a lateral direction which is normal to its axis.

According to this roller leveler, after moving a pair of diagonal directional upper and lower work rolls in the upper and lower direction, respectively, the lower work roll group is moved in the lateral direction so that the moved upper and lower work rolls may mutually face to the respective other fixed lower and upper work rolls. As a result, both upper and lower work roll groups having their pitches which are twice as large as those prior to their moving are newly composed. A work roll arranged in a large pitch, in comparison with the work roll arranged in a pitch smaller than that work roll, makes it possible to level the hoop shape having a larger thickness, on the basis of the same pressure applied to the hoop.

Now, the upper and lower work roll groups defining a pass line must be accurately arranged and maintained so that these axes may pass through the vertexes of the isosceles triangle. This is indispensable for the leveling of a thin plate.

In the prior art roller leveler, however, there is a large possibility that any abrasions, rusts, dust or the like produced between laterally movable supporting means for supporting the lower work roll group and the other portions of the roller leveler may damage the accurate arrangement of the lower work roll group. Therefore, it is not desirable for maintaining the highly accurate roller leveler to make the lower work roll group movable in a lateral direction.

SUMMARY OF THE INVENTION

An object of the present invention is to provide a roller leveler for enabling the enlargement of the pitches of the upper and lower work roll groups defining the pass line of a hoop, without making the lower work roll group movable in a lateral direction.

The roller leveler according to the present invention comprises a raisable upper work roll group, and a lower work roll group, the upper and lower work roll groups being arranged in a zigzag form so that the axes of three work rolls adjacent to each other at upper and lower sides and three points of intersection with the plane crossing with these axes may give three vertexes of an isosceles triangle, and the lower work rolls at the odd or even number, i.e. alternate positions in the lower work roll group being raisable.

The roller leveler, further, comprises two rows of upper backup roll groups placed around the axis of each upper work roll at a certain angular interval and extending along each upper roll, and two rows of lower backup roll groups placed angularly around the axis of each lower work roll and extending along each lower work roll.

Otherwise, the roller leveler comprises two rows of upper backup rolls angularly placed around the axis of each upper work roll and extending along each upper roll and one row of lower backup rolls placed right under each lower work roll.

According to the present invention, the raised lower work roll group becomes the upper work roll group defining the pass line in cooperation with the unlifted remaining lower work roll group, by raising alternate lower work rolls. The distance between the axes of the raised mutual lower work rolls and the distance between the axes of the remaining mutual lower work rolls, that is, the pitches of the work rolls become twice as large as those in the condition before the rise of the lower work roll. In this way, it is possible to level the hoop shape with the thickness exceeding the levelable maximum thickness by both upper and lower work roll groups before rising. In addition, as the rise of the lower work rolls are what is loosed from the original lower work roll group while maintaining the distance between the axes of the mutual lower work rolls as it is, an isosceles triangle as above-mentioned is strictly maintained between the raised lower work rolls and the remaining lower work rolls, and it is also maintained in a long-term use. Therefore, according to the present invention, the precision leveling of the hoop is guaranteed for any of thin plates up to thick plates.

In the prior art roller leveler, it was necessary to ascend and descend the upper and lower work rolls, respectively, and therefore, a backup roll could not be placed at the back of each work roll.

However, a mechanism for raising the lower work rolls is provided in the present invention, and therefore, the backup roll can be placed at the underside of each lower work roll. In addition, as each upper work roll is not raised individually, the backup rolls can be placed on the upper side thereof.

When the lower backup rolls are placed right under each lower work roll, the mill scale stripped off from the hoop passing through the pass line can be prevented from depositing on the lower backup rolls.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
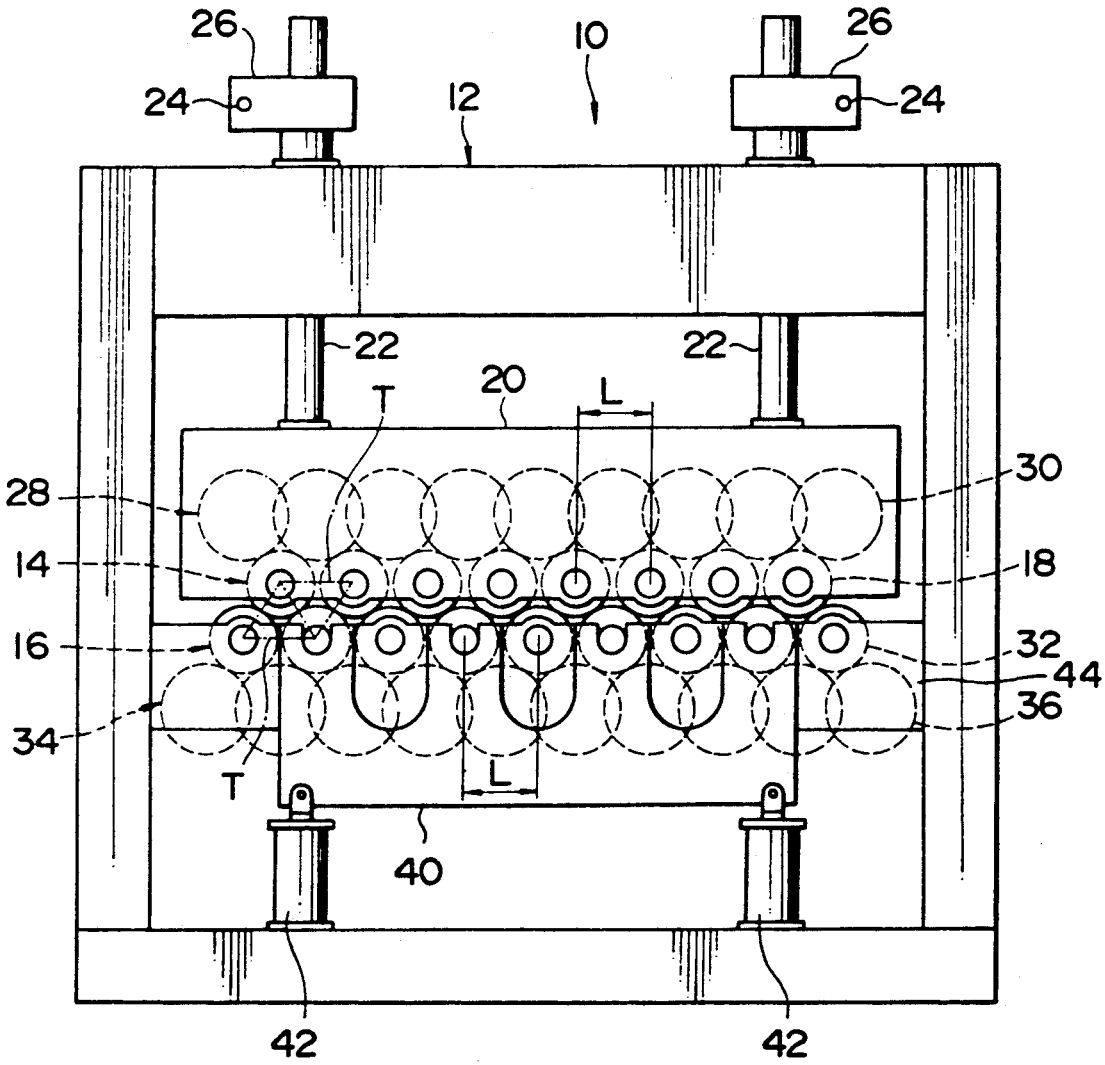
FIG. 1 is a front view showing a roller leveler as an embodiment of the present invention.

Referring to FIG. 1, reference numeral 10 indicates the whole of a roller leveler used for leveling the strain which is present at either the central or side portion in the cross direction of the hoop after its rolling process or in a dotted form.

The roller leveler 10 comprises a frame 12, an upper work roll group 14 supported by the frame 12 and a lower work roll group 16. Both work roll groups 14 and 16 define the pass line, through which the hoop to be leveled is passed.

The upper work roll group 14 is composed of a plurality (8 pieces in an illustrated embodiment) of upper work rolls 18 arranged in parallel with each other in a lateral row at a pitch L, and the eight upper work rolls 18 are supported rotatably by a box-like supporting body 20.

The supporting body 20 is suspended from the upper portion of the frame 12 through a plurality of suspended holding members 22. Each suspended holding member 22 is passed through the upper portion of the frame 12 in its vertical direction and screwed to the frame. The supporting body 20 is raised by rotating each suspended holding member 22 around its axis. When the upper work roll group 14 is pushed against the hoop on the lower work roll group 16 by lowering the supporting body 20, the hoop receives either a push pressure or a pressured force which is necessary for leveling.

Each suspended holding member 22 is rotated and driven through a torque transmitting shaft 24 and a rotational direction conversion device 26 which are connected to a driving shaft of a motor (not shown) and extend in parallel with the upper work rolls 18.

Two rows of upper backup roll groups 28 arranged angularly around the axis at the upper side of each upper work roll 18 are supported ascendably and descendably relative to each upper work roll 18 by the supporting body 20. The upper backup roll group 28 in each row is composed of a plurality of pairs of upper backup rolls 30 placed mutually at intervals along the upper work rolls 18 and rotatably contacting the upper work rolls 18.

On the other hand, the lower work roll group 16 is supported at the lower portion of the frame 12. The lower work roll group 16 is composed of a plurality (9 pieces in the illustrated embodiment) of lower work rolls 32 having the same diameter as that of the upper work roll 18. These lower work rolls 32 are placed horizontally in a row and in parallel with each other at the same pitch L as that between the mutual upper work rolls 18, and they are also placed in parallel with the upper work rolls 18.

At the lower portion of the frame 12, two rows of lower backup roll groups 34 placed angularly around the axis at the lower side of each lower work roll 32 are supported ascendably and descendably relative to each lower work roll 32. The backup roll group 34 in each row is composed of a plurality of pairs of lower backup rolls 36 placed mutually at intervals along the lower work rolls 32 and rotatably contacting the lower work rolls 32.

Figure 6:
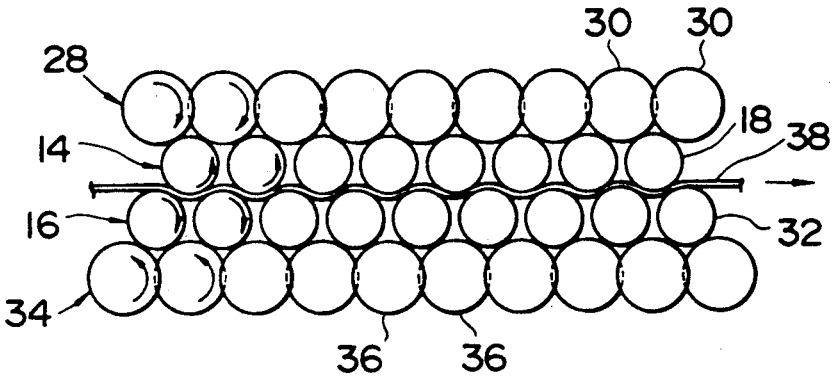
FIG. 6 is a schematic view showing the arrangement of the upper work roll group as well as the upper backup roll group and the lower work roll group as well as the lower backup roll group of FIG. 1.
Figure 7:
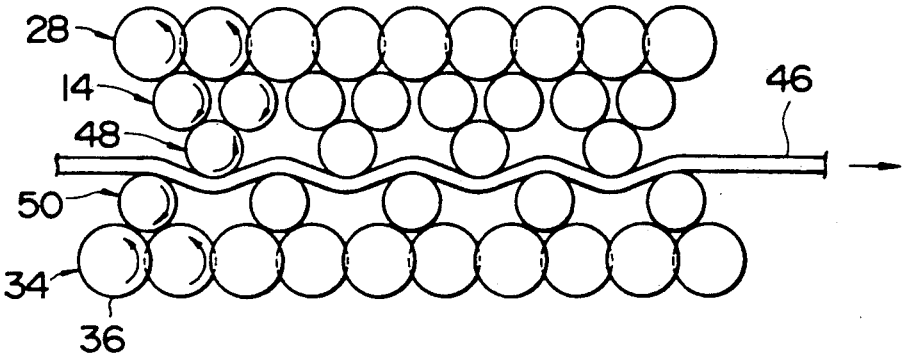
FIG. 7 is a schematic view showing the arrangement of the upper work roll group as well as the upper backup roll group and the lower work roll group as well as the lower backup roll group of FIG. 2.

The upper backup rolls 30 prevent the deflection of the upper work rolls 18 when a hoop 38 (FIGS. 6 and 8) is passed between both work roll groups 14 and 16. In addition, the lower backup rolls 36 are set up so as to prevent the deflection in the lower work rolls 32.

When the hoop 38 is passed between both work roll groups 14 and 16, the hoop 38 is bent repeatedly along a portion of the circumferential surface of each upper and lower work roll 18, 32 and receives a tension, and by this way, a plastic elongation is given to cancel the surface strain. That is, the surface shape is leveled. The plastic elongation becomes, in particular, maximum at the largest flexure portion of the lower work rolls 32, respectively.

Both of the upper and lower work roll groups 14 and 16 are positioned in a zigzag way so that the axes of three work rolls 18 and 32 adjoining mutually at upper and lower positions and three points of intersection with the plane crossing these axes may make three vertexes of an isosceles triangle T, and this relation is maintained.

It is required that this array relation of both work roll groups 14 and 16 be maintained strictly for the shape leveling of the relatively thinner hoop.

By the way, in the present invention, the lower work rolls at odd or even, i.e. alternate, number positions are raisable.

In an illustrated embodiment, the four lower work rolls 32 at even number positions are supported at both their ends by a pair of movable plate members 40 forming a part of the lower portion of the frame 12 and facing to each other.

Each plate member 40 is pivotally attached to and held by a pair of hydraulic cylinders or air cylinders 43 fixed to the base of the frame 12 and expandable in the vertical direction.

Figure 2:
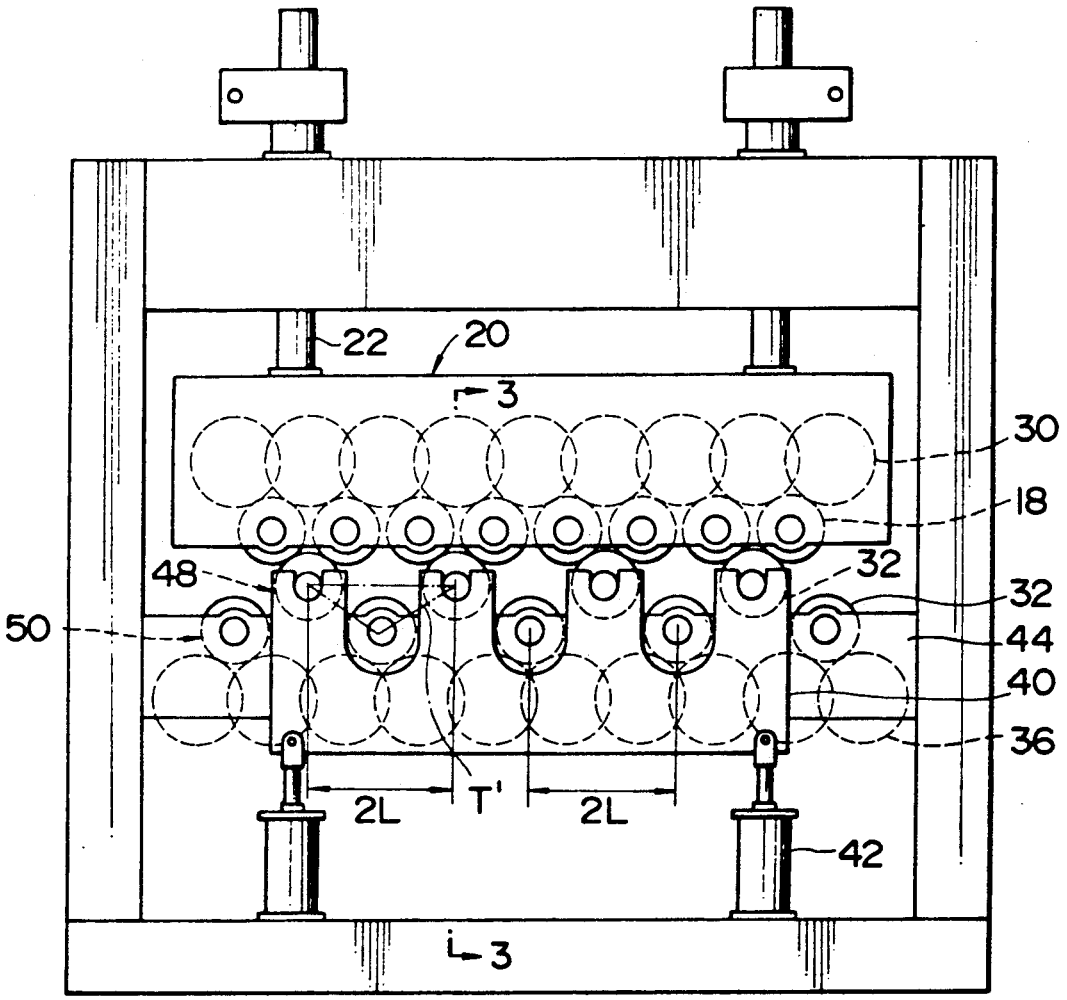
FIG. 2 is a front view showing the roller leveler in the condition after raising upper work rolls and a part of the lower work roll group, from the condition shown in FIG. 1.

As a result, the four lower work rolls 32 at the even number positions can be raised together with the plate member 40 by extending the air cylinder 42 (refer to FIG. 2). When the lower work rolls 32 are raised or preliminary thereto, the supporting body 20 of the upper work rolls 14 is also raised.

Referring now to FIG. 2, the four lower work rolls 32 raised at even number positions define the pass line for a thicker hoop 46 (refer to FIGS. 3, 5, 7 and 11), in cooperation with the five lower work rolls 32 at odd number positions supported by a pair (only one of them is shown) of fixed plate members 44 which make a part of the lower portion of the frame 12.

The lower work roll group 48 (designated as "a first lower work roll group" hereafter) raised at even number positions and the lower work roll group 50 (designated as "a second lower work roll group" hereafter) at the odd number positions as it was, have an array relation in a zigzag form that the axes of the three lower work rolls 32 adjacent to each other and the three points of intersection with the plane crossing with these axes may make three vertexes of an isosceles triangle T' (FIG. 2). Therefore, a precise modification of the shape of a hoop 46 passing through the pass line is possible.

The first lower work roll group 48 acts as an upper work roll group to the second lower work roll group 50, and the upper work roll group 14 acts as an intermediate roll group between the first lower work roll group 48 and the upper backup roll group 28.

Also, the pitches of the first and second lower work roll groups 48 and 50 become twice as large as those of the upper work roll group 14 and the lower work roll group 16 in the original condition shown in FIG. 1, that is, 2L.

Each work roll of the first and second lower work roll groups 48 and 50 with enlarged pitches gives a larger bending and a larger tension to the hoop under the same pressure, in comparison with each work roll of the upper work roll group 14 and the lower work roll group 16 before the pitches are enlarged. Therefore, the thickness of the hoop able to be bent and extended to cancel the strain of the hoop under the maximum pressure is larger after the pitches are enlarged (FIG. 2) than before they are enlarged (FIG. 1). This means that the shape leveling of hoops with a wider range of thickness dimension can be made by a single roller leveler.

For example, in case each of work rolls 18 and 32 is 50 mm in diameter and has a pitch L of 53 through 55 mm, the thickness dimension of a hoop 38 able to be leveled by the roller leveler 10 in the condition shown in FIG. 1 ranges from 0.5 mm to 3.2 mm.

In contrast, in the roller leveler in the condition shown in FIG. 2 where the pitch L is doubled, the leveling of a hoop 46 with the thickness ranging from 2.0 mm to 6.0 mm is possible.

Therefore, in the case of the roller leveler 10 shown in the illustrated embodiment, the leveling of the hoop 46 with the thickness ranging from 0.5 mm to 6.0 mm is possible.

Figure 3:
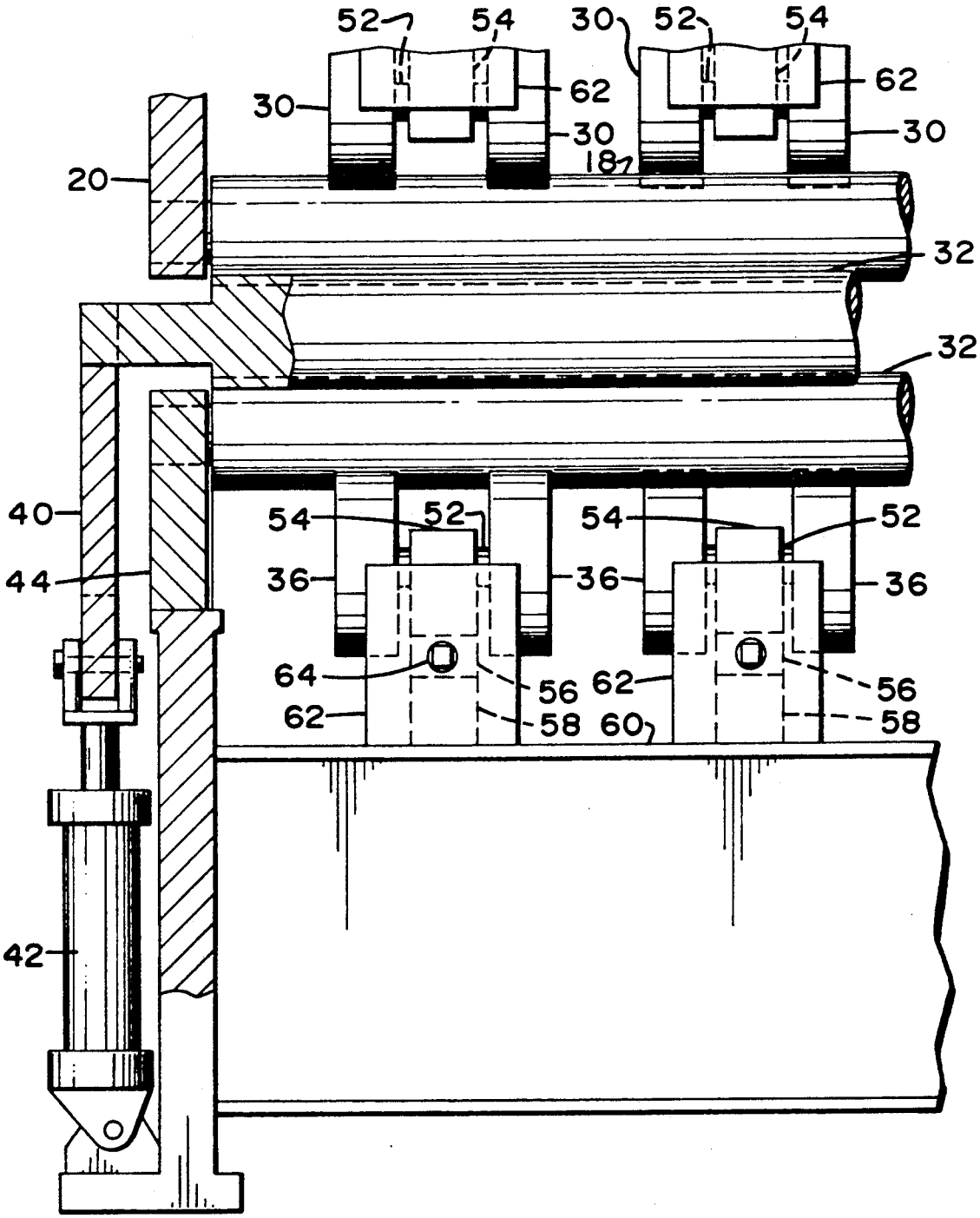
FIG. 3 is a partial sectional view taken along the line 3—3 of FIG. 2.
Figure 4:
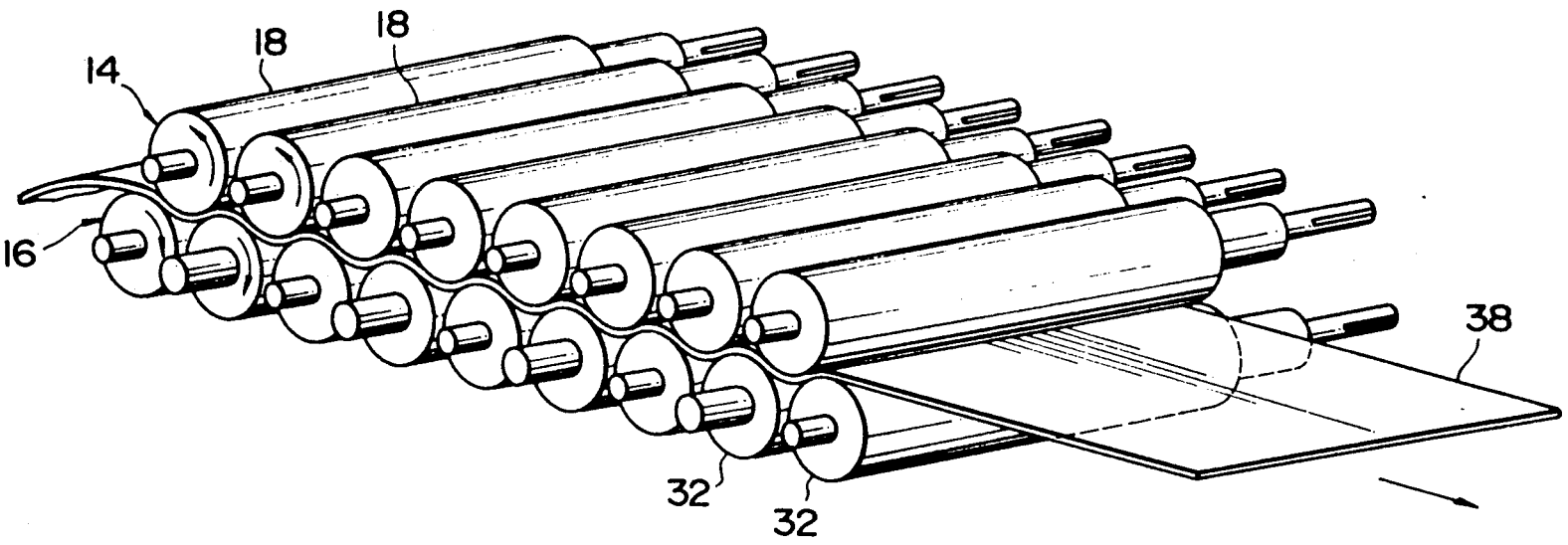
FIG. 4 is a schematic perspective view showing the arrangement of the upper work roll group and the lower work roll group of FIG. 1.
Figure 5:
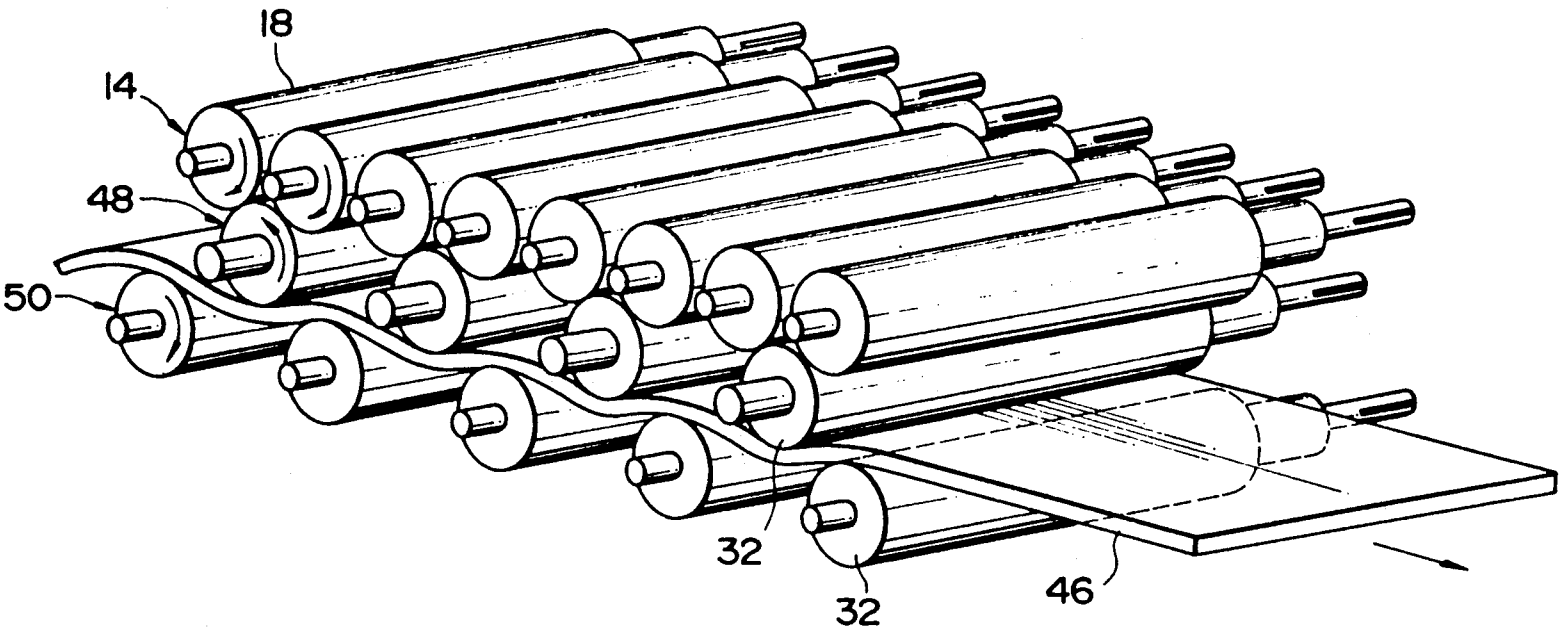
FIG. 5 is a schematic perspective view showing the arrangement of the upper work roll group and the lower work roll group of FIG. 2.

Referring now to FIG. 3, each pair of lower backup rolls 36 in each row is interconnected through a shaft member 52, which is also supported rotatably through an elongate and plate-like bearing member 54. The bearing member 54 extends in the horizontal direction perpendicular to these axes at the underside of all lower work rolls 32.

A key member 56 and a base member 58 having the inclined face contacting each other and also having the almost same width and length dimension are placed at the underside of the bearing member 54.

The base member 58 is fixed to a plurality of the opposite plate members 60 (only one of them is shown) forming a part of the lower portion of the frame 12. Just as the bearing member 54 is movable only in the vertical direction and the key member 56 is movable only in the vertical direction and in its longitudinal direction, both ends of them are held by the plate members 60 through a pair of holding members 62. Furthermore, a screw rod 64 passing through one holding member 62 and extending is screwed into one end of the key member 56. When the screw rod 64 is turned, the key member 56 moves along the inclined face in its longitudinal direction and vertical direction. As a result, a plurality of pairs of lower backup rolls 36 supported by the bearing member 54 move vertically.

The raising mechanism of the lower backup rolls 36 is applied similarly to the upper backup rolls 30. To avoid a repetition of the explanation, the raising mechanism of the upper backup rolls 30 is partially shown, and only the corresponding symbol to each portion of the raising mechanism of the lower backup rolls 36 is given.

However, as it becomes apparent by comparing respectively between FIGS. 4 and 5, FIGS. 6 and 7, FIGS. 8 and 9 and FIGS. 10 and 11, the direction of the rotation of each lower work roll 32 (FIGS. 4, 6, 8 and 10) prior to raising is clockwise, whereas that of each lower work roll 32 (FIGS. 5, 7, 9 and 11) of the first lower work roll group 48 is counterclockwise. In consideration of the variation of the rotational direction before and after raising, it is desirable to construct such that only the raisable lower work rolls in the lower work rolls are driven to rotate.

Figure 8:
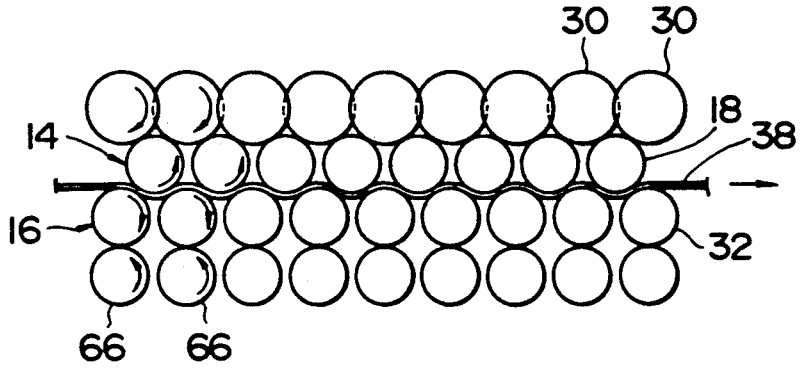
FIG. 8 is a schematic view similar to that of FIG. 6, but showing the lower backup rolls arranged right under the lower work rolls.
Figure 9:
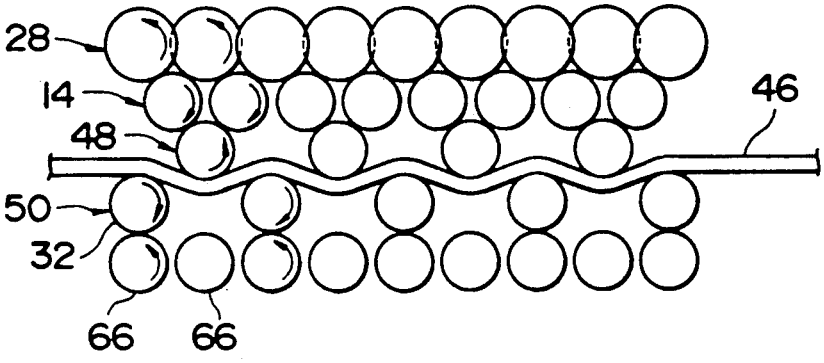
FIG. 9 is a schematic view similar to that of FIG. 7, but showing the lower backup rolls arranged right under the lower work rolls.

As shown in FIGS. 8 and 9, the lower backup rolls 66 may be placed right under each lower work roll 32. It is desirable that the lower backup rolls 66 have the same diameter as that of each lower work roll 32. According to this, any hard mill scale to peel off from the surface of the hoop when the hoop 38 or 46 is bent can be prevented from depositing on the lower backup rolls 66 by the scale passing between the lower backup rolls 66.

Figure 10:
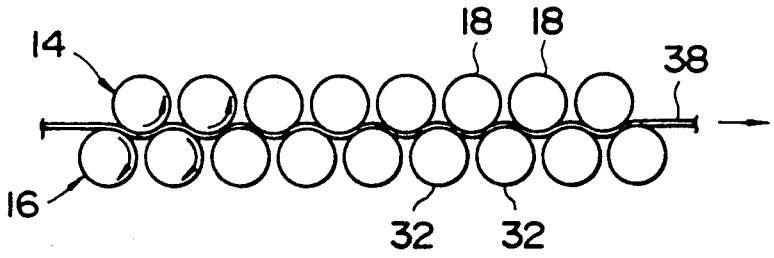
FIG. 10 is a schematic view similar to that of FIG. 6, but showing a case where the upper backup rolls and the lower backup rolls are not arranged.
Figure 11:
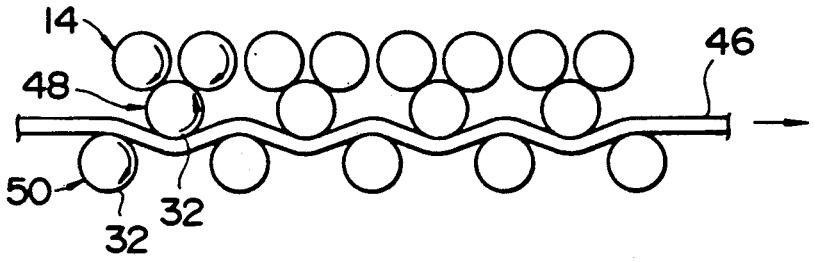
FIG. 11 is a schematic view similar to that of FIG. 7, but showing a case where the upper backup rolls and the lower backup rolls are not arranged.

Furthermore, as shown in FIGS. 10 and 11, the present invention can be applied to the roller leveler having no backup roll groups.

What is claimed is:

1. A roller leveler comprising:

raisable upper work rolls; and lower work rolls having raisable alternate work rolls;

said upper and lower work rolls being offset from one another to define a pass line through which a hoop to be leveled is passed in engagement with the work rolls so as to feed said hoop along a substantially undulating leveling path, wherein the lower work rolls are all in contact with the upper work rolls to define a first leveling path when a relatively thin hoop is leveled, and wherein the upper work rolls are raised, and the alternate lower work rolls are raised above the other lower work rolls and act as upper work rolls in conjunction with the other lower work rolls to define a second leveling path when a relatively thick hoop is leveled, said upper work rolls being out of contact with the thick hoop when said alternate and other lower work rolls define said second path.

2. A roller leveler according to claim 1, further comprising two rows of upper backup roll groups placed angularly around the axis of each upper work roll and extending along each upper work roll, and two rows of lower backup roll groups placed angularly around the axis of each lower work roll and extending along each lower work roll.

3. A roller leveler according to claim 1, further comprising two rows of upper backup roll groups placed angularly around the axis of each upper work roll and extending along each upper work roll, and one row of lower backup rolls placed directly under each lower work roll.

* * * * *

UNITED STATES PATENT AND TRADEMARK OFFICE

CERTIFICATE OF CORRECTION

PATENT NO. : 5,127,250

DATED : Jul. 7, 1992

INVENTOR(S) : Toshio Nagata

It is certified that error appears in the above-identified patent and that said Letters Patent is hereby corrected as shown below:

On title page, item [73] Assignee, change to read as follows:
"Kohan Sendan Kikai Kabushiki Kaisha, Chiba-ken, Japan"

Signed and Sealed this

Fourteenth Day of September, 1993

Bruce Lehman

*Attest:*

BRUCE LEHMAN

*Attesting Officer*

*Commissioner of Patents and Trademarks*